US007221237B2

(12) United States Patent
Liang et al.

(10) Patent No.: US 7,221,237 B2
(45) Date of Patent: May 22, 2007

(54) FREQUENCY TUNABLE DEVICE

(75) Inventors: Chun-Sheng Liang, Changhua Hsien (TW); Mei-Hui Wu, Changhua Hsien (TW); Jenn-Ming Wu, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 11 days.

(21) Appl. No.: 10/982,497

(22) Filed: Nov. 5, 2004

(65) Prior Publication Data

US 2005/0212615 A1 Sep. 29, 2005

(30) Foreign Application Priority Data

Mar. 24, 2004 (TW) ..... 93107959 A

(51) Int. Cl.
*H01P 1/11* (2006.01)
*H01P 1/215* (2006.01)
*H01P 1/23* (2006.01)

(52) U.S. Cl. ..... 333/24 C; 438/3; 438/396

(58) Field of Classification Search ..... 333/24 C; 310/358; 360/320; 505/329; 483/3, 396
See application file for complete search history.

(56) References Cited

U.S. PATENT DOCUMENTS 4,367,426 A * 1/1983 Kumada et al. ..... 310/358
5,182,695 A * 1/1993 Handa et al. ..... 361/321.5
5,401,716 A * 3/1995 Yamazaki ..... 505/329
6,777,248 B1 * 8/2004 Nabatame et al. ..... 438/3

FOREIGN PATENT DOCUMENTS

GB 2077253 A * 6/1981
GB 2149121 A * 10/1993

* cited by examiner

*Primary Examiner*—Dean Takaoka
(74) *Attorney, Agent, or Firm*—Ladas & Parry LLP

(57) ABSTRACT

A frequency tunable device includes a substrate, and a capacitor structure supported by the substrate and including a ferroelectric film and first and second electrodes. The ferroelectric film has two opposite sides, and is made from a ferroelectric material having a formula of $Pb_{1-x}Ba_xZrO_3$, where x is a positive number greater than 0.3 and less than 0.6. The first and second electrodes are respectively formed on the sides of the ferroelectric film. The dielectric constant of the ferroelectric film varies with a voltage applied to the first and second electrodes.

6 Claims, 4 Drawing Sheets

FREQUENCY TUNABLE DEVICE

CROSS-REFERENCE TO RELATED APPLICATION

This application claims priority of Taiwanese Application No. 093107959, filed on Mar. 24, 2004.

BACKGROUND OF THE INVENTION

1. Field of the Invention

This invention relates to a frequency tunable device, more particularly to a frequency tunable device including a substrate and a dielectric film formed on the substrate and made from a $Pb_{1-x}Ba_xZrO_3$ferroelectric material with a dielectric property being a function of a voltage applied thereto.

2. Description of the Related Art

U.S. Pat. No. 5,589,845 discloses a tunable electric antenna apparatus that includes a component of a thin film ferroelectric material, such as $SrTiO_3$, $Pb(Sr, Ti)O_3$, $Sr_xBa_{1-x}TiO_3$ (BST), etc. The ferroelectric material has a dielectric property that is a function of a voltage applied to the thin film ferroelectric material. Such a dielectric property enables the ferroelectric material to modulate the dielectric constant and hence the time delay of either microstrip or coplanar delay lines, and allows for use in producing phase shifters, antennas, etc.

BST ferroelectric materials tend to degrade due to the reduction of $Ti^{4+}$ into $Ti^{3+}$, which, in turn, results in an increase in dielectric loss. This degradation problem can be alleviated by adding an aliovalent element into the BST ferroelectric materials. The following patents are examples of reducing dielectric loss through the addition of an aliovalent element into the BST ferroelectric materials.

U.S. Pat. No. 5,312,790 discloses a ceramic ferroelectric material consisting essentially of BST and alumina for achieving the desired electric property, such as a low dielectric constant, a low loss tangent, and high tunability. U.S. Pat. No. 5,427,988 discloses a ceramic ferroelectric material consisting essentially of BST and magnesia. U.S. Pat. No. 5,486,491 discloses a ceramic ferroelectric material consisting essentially of BST and zirconia.

Although the addition of an aliovalent element into ferroelectric material can reduce dielectric loss, it also results in reduction in the tunability of the ferroelectric material.

The entire disclosure of U.S. Pat. No. 5,589,845 is incorporated herein by reference.

SUMMARY OF THE INVENTION

The object of the present invention is to provide a frequency tunable device that possesses high tunability and a low loss tangent.

According to this invention, a frequency tunable device comprises a substrate, and a capacitor structure supported by the substrate and including a ferroelectric film and first and second electrodes. The ferroelectric film has two opposite sides, and is made from a ferroelectric material having a formula of $Pb_{1-x}Ba_xZrO_3$, where x is a positive number greater than 0.3 and less than 0.6. The first and second electrodes are respectively formed on the sides of the ferroelectric film. The dielectric constant of the ferroelectric film varies with a voltage applied to the first and second electrodes.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
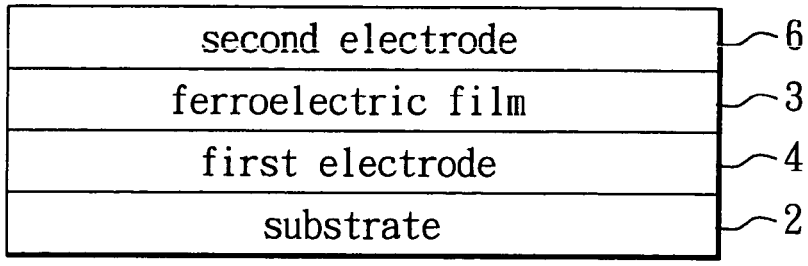
FIG. 1 is a schematic view of the first preferred embodiment of a frequency tunable device according to this invention.

Before the present invention is described in greater detail, it should be noted that same reference numerals have been used to denote like elements throughout the specification.

FIG. 1 illustrates the first preferred embodiment of a frequency tunable device according to the present invention.

The frequency tunable device includes a substrate 2, and a capacitor structure (MIM structure) supported by the substrate 2 and including a ferroelectric film 3 and first and second electrodes 4, 6. The ferroelectric film 3 has two opposite sides, and is made from a ferroelectric material that exhibits a paraelectric phase and that has a formula of $Pb_{1-x}Ba_xZrO_3$ (PBZ), where x is a positive number greater than 0.3 and less than 0.6. The first and second electrodes 4, 6 are respectively formed on the sides of the ferroelectric film 3. The dielectric constant of the ferroelectric film 3 varies with a voltage applied to the first and second electrodes 4, 6.

In this embodiment, the first electrode 4 is formed on the substrate 2. The ferroelectric film 3 is sandwiched between the first and second electrodes 4, 6.

Preferably, the substrate 2 is made from a material selected from the group consisting of Si, GaAs, $SrTiO_3$, $LaAlO_3$, and MgO. More preferably, the substrate 2 is made from MgO.

Preferably, the first electrode 4 is made from a material selected from the group consisting of Pt, $LaNiO_3$, (La, Sr)

$CoO_3$, $SrRuO_3$, and $YBa_2Cu_3O_{7-x}$. More preferably, the first electrode 4 is made from Pt. The second electrode 6 is preferably made from Pt.

Figure 2:
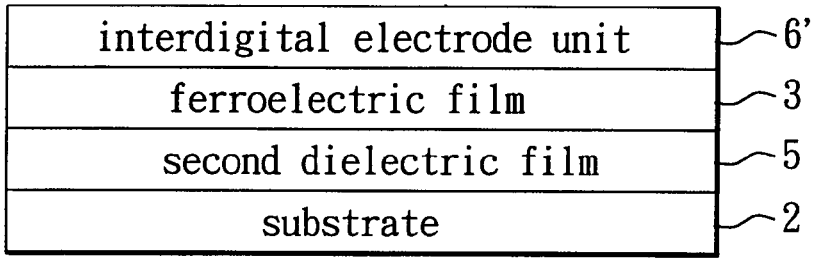
FIG. 2 is a schematic view of the second preferred embodiment of the frequency tunable device according to this invention.

FIG. 2 illustrates the second embodiment of the frequency tunable device according to this invention. The second embodiment differs from the previous embodiment in that the capacitor structure is a MII structure with an inter-digital electrode unit 6' formed on the ferroelectric film 3, and that a dielectric film 5 is further provided in the frequency tunable device of the first embodiment. The inter-digital electrode unit 6' includes first and second electrodes (not shown) that are formed on an upper surface of the ferroelectric film 3 and that are spaced apart from each other. The substrate 2 is made from Si or GaAs for this embodiment. The dielectric film 5 is sandwiched between the substrate 2 and the ferroelectric film 3, and is made from a material selected from the group consisting of $TiO_x$, $Ta_2O_5$, (1−x) $ZrO_{2-x}Y_2O_3$, and $Bi_4Ti_3O_{12}$. Preferably, the dielectric film 5 is made from $Ta_2O_5$. The dielectric film 5 functions to prevent electromagnetic waves from propagating in a direction toward the substrate 2.

Figure 3:
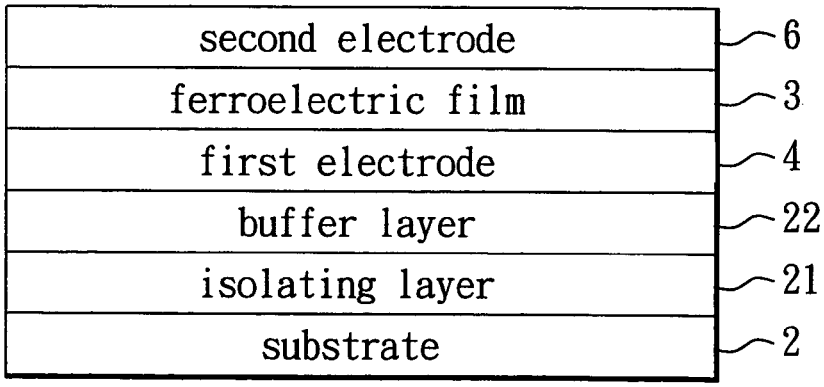
FIG. 3 is a schematic view of the third preferred embodiment of the frequency tunable device according to this invention.

FIG. 3 illustrates the third preferred embodiment of the frequency tunable device according to this invention. The third embodiment differs from the first embodiment in that an isolating layer 21 and a buffer layer 22 are further provided in the frequency tunable device of the first embodiment. Preferably, the isolating layer 21 is preferably made from $SiO_2$ when the substrate 2 is made from Si.

Preferably, the buffer layer 22 is made from a material selected from the group consisting of Ti, $TiO_2$, Ta, $Ta_2O_5$, and TiN. More preferably, the buffer layer 22 is made from Ti.

The frequency tunable device of this invention can be prepared by chemical solution deposition techniques that include the following steps: (a) preparing a Pb/Ba-containing solution by dissolving lead acetate and barium acetate in an organic acid; (b) preparing a Zr-containing solution by dissolving zirconium alkoxide in a mixture of alcohol and a chelating agent by refluxing at a temperature of about 110° C.; (c) mixing the Pb/Ba-containing solution and the Zr-containing solution in an alcohol for forming a precursor; (d) spin coating the precursor on the first electrode 4 on the substrate 2; (e) drying and sintering the precursor on the first electrode 4 at a predetermined sintering temperature so as to form the ferroelectric film 3 on the first electrode 4; and (f) forming the second electrode 6 on the dielectric film 3.

The organic acid used in step (a) is preferably selected from the group consisting of acetic acid, propionic acid, and mixtures thereof.

The zirconium alkoxide used in step (b) is preferably selected from the group consisting of zirconium n-propoxide, zirconium n-butoxide, and mixtures thereof.

The alcohol used in step (c) is preferably selected from the group consisting of 2-methoxyethanol, methanol, ethanol, isopropanol, and mixtures thereof.

Preferably, the chelating agent used in step (c) is acetylacetone.

The sintering temperature in step (e) preferably ranges from 550 to 800° C., and more preferably ranges from 600 to 750° C.

The precursor formed in step (c) can be added with an aliovalent element, such as La, Nb, V, and W, so that after the sintering operation the aliovalent element can replace one of the atoms in a lattice of the crystal of the ferroelectric material.

Figure 4:
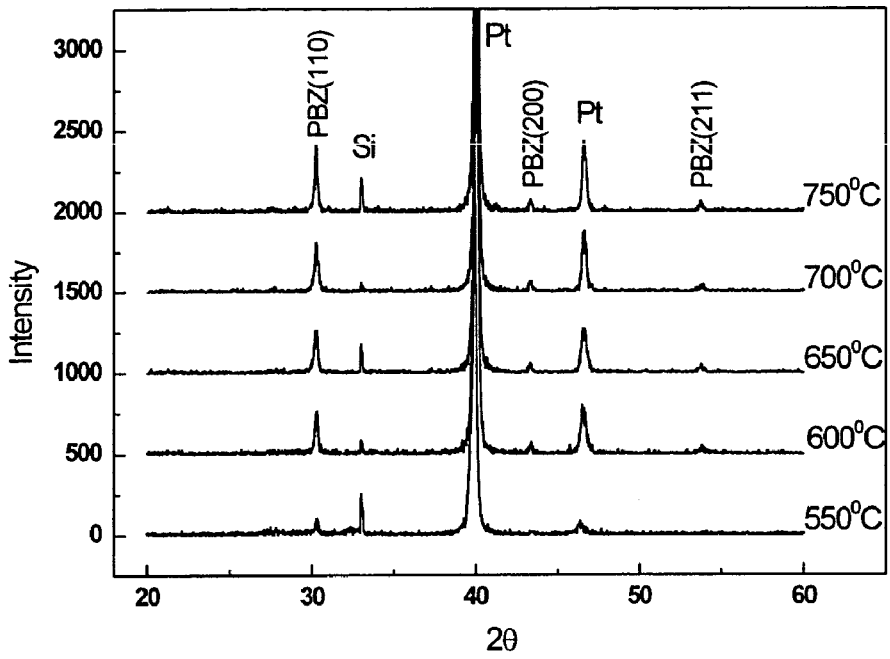
FIG. 4 is a graph of X-ray diffraction patterns used to characterized the crystal structure of samples of a ferroelectric material of the preferred embodiments which are prepared under different sintering temperatures.

FIG. 4 shows the X-ray diffraction patterns of the crystal structure for different samples of the ferroelectric film sintered which are prepared under different sintering temperatures. The results show that diffraction peaks of the ferroelectric material (PBZ) are increased with increases in the sintering temperature.

Figure 5:
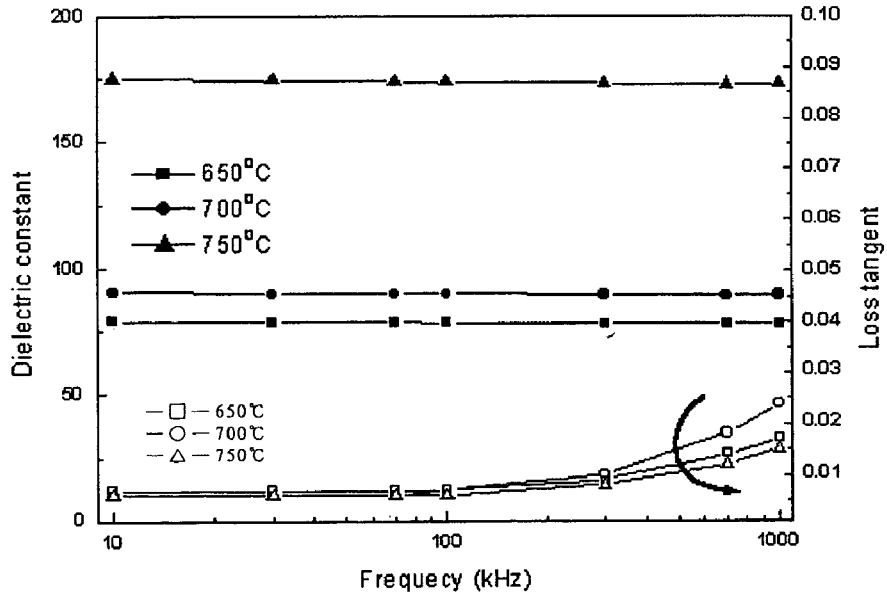
FIG. 5 is a graph of dielectric constant and loss tangent versus frequency for samples of the ferroelectric material of the preferred embodiments which are prepared under different sintering temperatures.

FIG. 5 is a graph of dielectric constant and loss tangent versus frequency for different samples of the ferroelectric material which are prepared under different sintering temperatures. The results show that the dielectric constant of the ferroelectric material increases with increases in the sintering temperature. This is particularly the case when the sintering temperature is raised to 750° C. Further, it is also evident that the loss tangent slightly increases with increases in the sintering temperature.

Figure 6:
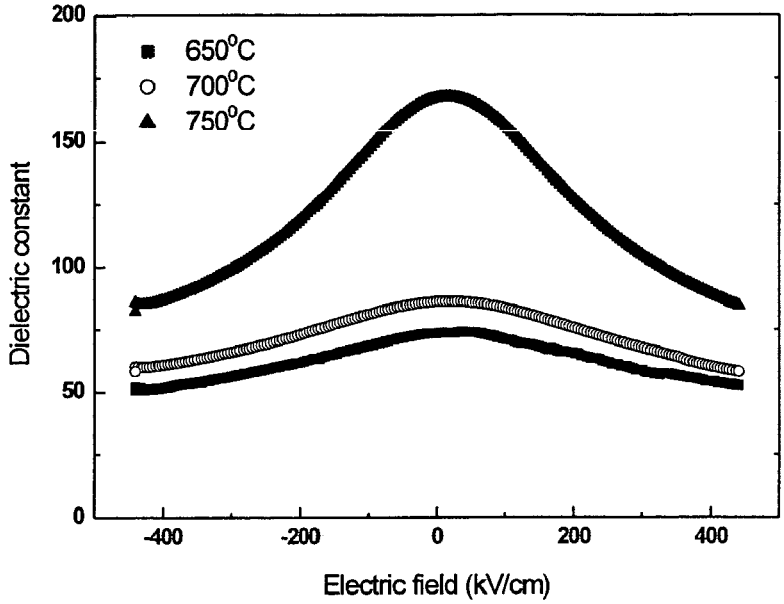
FIG. 6 is a graph of dielectric constant versus electric field for samples of the ferroelectric material of the preferred embodiments which are prepared under different sintering temperatures.

FIG. 6 is a graph of dielectric constant versus electric field for different samples of the ferroelectric material which are prepared under different sintering temperatures. The results show that the extent of non-linearity of the dielectric constant curve is larger with increases in the sintering temperature.

Figure 7:
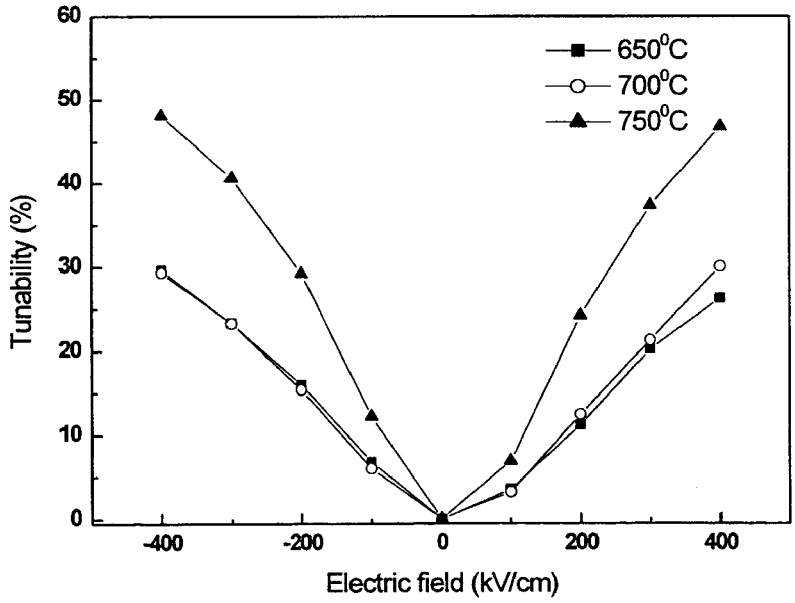
FIG. 7 is a graph of tunability versus electric field for samples of the ferroelectric material of the preferred embodiments which are prepared under different sintering temperatures.

FIG. 7 is a graph of tunability versus electric field for different samples of the ferroelectric material which are prepared under different sintering temperatures. The results show that the tunability increases with the sintering temperature. This is particularly the case when the sintering temperature is raised to 750° C.

Figure 8:
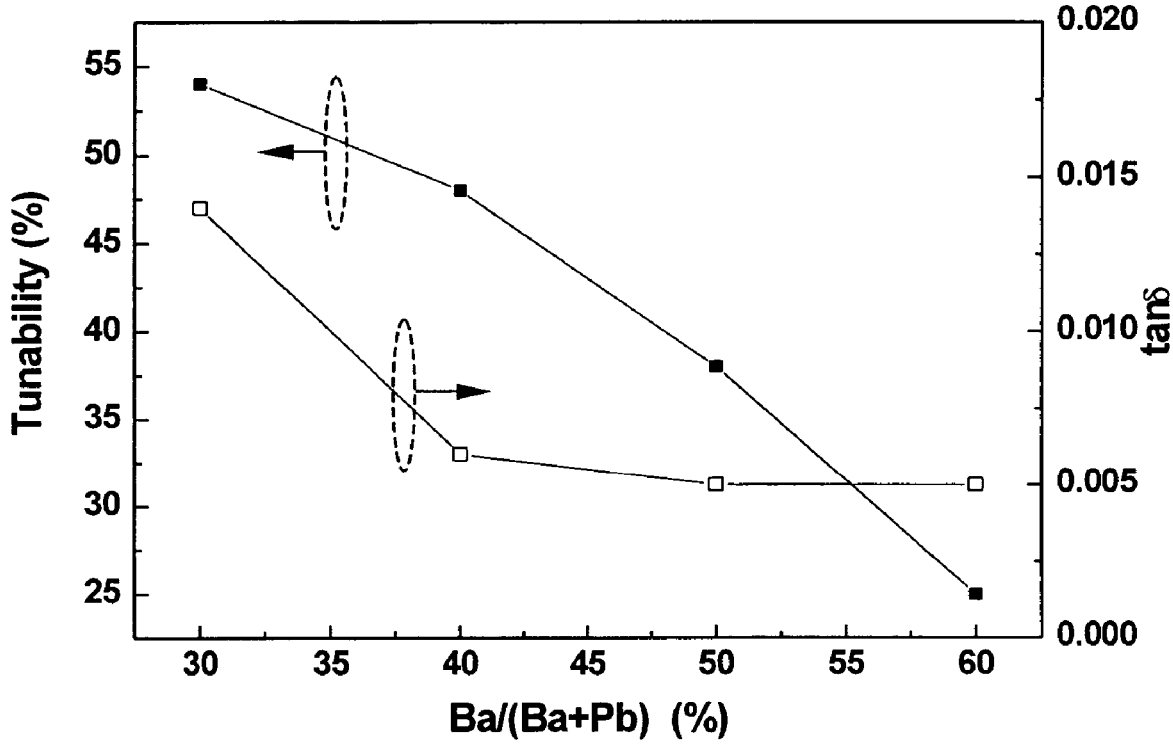
FIG. 8 is a graph of tunability and loss tangent for samples of the ferroelectric material of the preferred embodiments having different ratios of Ba/(Ba+Pb) in the ferroelectric material.

FIG. 8 is a graph of tunability and loss tangent of the ferroelectric material of the ferroelectric film 3 of this invention versus the mole ratio of Ba to (Ba+Pb) used in the ferroelectric film 3. The results show that the ferroelectric material of this invention possesses a high tenability and low loss tangent within a mole ratio of Ba to (Ba+Pb) from about 0.3 to about 0.6.

As shown in FIGS. 4 to 8, the electric properties of the ferroelectric material of the ferroelectric film of the frequency tunable device of this invention possesses a relatively high tunability and low loss tangent, and thus is useful for producing frequency tunable devices, such as phase shifters, antennas, etc.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. A frequency tunable device comprising:

a substrate;

a capacitor structure supported by said substrate and including a ferroelectric film made from a ferroelectric material exhibiting a paraelectric phrase and having a formula of $Pb_{1-x}Ba_xZrO_3$, where x is a positive number greater than 0.3 and less than 0.6, and first and second electrodes formed on said ferroelectric film; and a dielectric film sandwiched between said substrate and said ferroelectric film and made from a material selected from the group consisting of $TiO_X$, $Ta_2O_5$, (1−x) $ZrO_{2-x}Y_2O_3$, and $Bi_4Ti_3O_{12}$, wherein the dielectric constant of said ferroelectric film varies with a voltage applied to said first and second electrodes.

2. The frequency tunable device of claim 1, wherein said first electrode is formed on said substrate, said ferroelectric film being sandwiched between said first and second electrodes.

3. The frequency tunable device of claim 2, wherein said substrate is made from a material selected from the group consisting of Si, GaAs, $SrTiO_3$, $LaAlO_3$, and MgO.

4. The frequency tunable device of claim 3, wherein said first electrode is made from a material selected from the group consisting of Pt, $LaNiO_3$, (La, Sr)$CoO_3$, $SrRuO_3$, and $YBa_2Cu_3O_{7-x}$.

5. The frequency tunable device of claim 1, further comprising an isolating layer formed on said substrate, said substrate being made from Si, said isolating layer being made from $SiO_2$.

6. The frequency tunable device of claim 5, further comprising a buffer layer formed on said isolating layer and made from a material selected from the group consisting of Ti, $TiO_2$, Ta, $Ta_2O_5$, and TiN.

* * * * *